US011104549B2

(12) United States Patent
Rocher et al.

(10) Patent No.: US 11,104,549 B2
(45) Date of Patent: Aug. 31, 2021

(54) MACHINE MOUNTING STRUCTURE FOR ELEVATOR SYSTEM

(71) Applicants: Otis Elevator Company, Farmington, CT (US); Jean-Emile Rocher, Gien (FR)

(72) Inventors: Jean-Emile Rocher, Gien (FR); Pascal Rebillard, Gien (FR); Bi Xiong, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 242 days.

(21) Appl. No.: 15/776,651

(22) PCT Filed: Nov. 25, 2015

(86) PCT No.: PCT/IB2015/002376
§ 371 (c)(1),
(2) Date: May 16, 2018

(87) PCT Pub. No.: WO2017/089855
PCT Pub. Date: Jun. 1, 2017

(65) Prior Publication Data

US 2018/0327229 A1 Nov. 15, 2018

(51) Int. Cl.
*B66B 11/00* (2006.01)
*B66B 19/00* (2006.01)
*B66B 7/02* (2006.01)

(52) U.S. Cl.
CPC ..... *B66B 11/0045* (2013.01); *B66B 7/027* (2013.01); *B66B 19/005* (2013.01)

(58) Field of Classification Search
CPC ... B66B 7/027; B66B 11/0045; B66B 19/005; B66B 19/007
See application file for complete search history.

(56) References Cited

U.S. PATENT DOCUMENTS 4,807,723 A * 2/1989 Salmon ..... B66B 11/08 187/254
5,490,578 A 2/1996 Esko et al.
5,899,300 A 5/1999 Miller et al.
7,493,989 B2 2/2009 Esko et al.
(Continued)

FOREIGN PATENT DOCUMENTS

CN 102232051 A 11/2011
CN 203143870 U 8/2013
(Continued)

OTHER PUBLICATIONS

PCT ISR Written Opinion; International Application No. PCT/IB2015/002376; International Filing Date: Nov. 25, 2015; dated Aug. 23, 2016; pp. 1-4.
(Continued)

*Primary Examiner* — Minh Truong
(74) *Attorney, Agent, or Firm* — Cantor Colburn LLP

(57) ABSTRACT

A machine assembly for use in an elevator system includes a support structure having a first end connected to an adjacent support member and a second end supported by at least one car guide rail. The support structure is arranged generally perpendicular to the support member and is configured to receive at least one component of the elevator system.

12 Claims, 2 Drawing Sheets

(56) References Cited

U.S. PATENT DOCUMENTS

| | | | | |
|---|---|---|---|---|
| 7,543,685 | B2 * | 6/2009 | Ach | B66B 11/004 187/250 |
| 8,302,740 | B2 * | 11/2012 | Swaybill | B66B 7/08 187/254 |
| 8,793,939 | B2 | 8/2014 | Landry et al. | |
| 8,820,483 | B2 * | 9/2014 | Ericson | B66B 19/005 187/266 |
| 9,919,900 | B2 * | 3/2018 | St. Pierre | B66B 7/08 |
| 2006/0266592 | A1 | 11/2006 | Monzon et al. | |
| 2010/0084224 | A1 | 4/2010 | Hao | |
| 2010/0155181 | A1 | 6/2010 | Coquerelle et al. | |
| 2011/0240407 | A1 * | 10/2011 | Ericson | B66B 19/005 187/250 |
| 2014/0166408 | A1 | 6/2014 | Rogers et al. | |
| 2015/0083525 | A1 | 3/2015 | Bruno et al. | |
| 2015/0083526 | A1 * | 3/2015 | Rogers | B66B 7/00 187/290 |

FOREIGN PATENT DOCUMENTS

| | | | |
|---|---|---|---|
| CN | 204185077 | U | 3/2015 |
| EP | 1123891 | A2 | 8/2001 |
| EP | 1405813 | A1 | 4/2004 |
| EP | 1422184 | A2 | 5/2004 |
| EP | 1571113 | B1 | 10/2010 |
| EP | 2361214 | A1 | 8/2011 |
| WO | 0174704 | A1 | 10/2001 |
| WO | 2005121012 | A1 | 12/2005 |
| WO | 2006053934 | A1 | 5/2006 |

OTHER PUBLICATIONS

PCT Notification of Transmittal of the International Search Report; International Application No. PCT/IB2015/002376; International Filing Date: Nov. 25, 2015; dated Aug. 23, 2016; pp. 1-5.

Chinese Office Action; International Application No. 201580084902.0; International Filing Date: May 25, 2018; dated Dec. 10, 2019; 6 pages.

Chinese Office Action; International Application No. 201580084902.0; International Filing Date: May 25, 2018; dated Jul. 9, 2020; 4 pages.

Second Office Action; Chinese Application No. 201580084902.0; International Filing Date: May 25, 2018; dated Nov. 26, 2020; 5 pages including English translation.

* cited by examiner

MACHINE MOUNTING STRUCTURE FOR ELEVATOR SYSTEM

CROSS REFERENCE TO RELATED APPLICATIONS

This application is a National Stage application of PCT/IB2015/002376, filed Nov. 25, 2015, which is incorporated by reference in its entirety herein.

BACKGROUND OF THE DISCLOSURE

This disclosure generally relates to the elevator installation and maintenance, and more particularly to the suspension arrangement of an elevator system.

A typical traction elevator system includes a car and a counterweight disposed within a hoistway, a plurality of tension ropes that interconnect the car and counterweight, and a drive machine having a drive sheave engaged with the tension ropes to drive the car and the counterweight. The ropes, and thereby the car and counterweight, are driven by rotating the drive sheave. Traditionally, the drive machine and its associated equipment were housed in a separate machine room.

Newer elevator systems have eliminated the need for a separate machine room by mounting the drive machine in the hoistway. These elevator systems are referred to as machine room-less systems. Due to the limited space available in the hoistway, these systems often require that additional components, such as deflector or idler sheaves for example, are mounted directly to the car. As a result, at higher speeds of operation, the ride quality of the system decreases. More specifically, the noise and vibration felt by a person within the elevator car may be increased.

BRIEF DESCRIPTION

According to one embodiment of the disclosure, a machine assembly for use in an elevator system includes a support structure having a first end connected to an adjacent support member and a second end supported by at least one car guide rail. The support structure is arranged generally perpendicular to the support member and is configured to receive at least one component of the elevator system.

In addition to one or more of the features described above, or as an alternative, in further embodiments the at least one component includes a dead end hitch.

In addition to one or more of the features described above, or as an alternative, in further embodiments the dead end hitch is mounted vertically to the support structure.

In addition to one or more of the features described above, or as an alternative, in further embodiments the dead end hitch is mounted horizontally to the support structure.

In addition to one or more of the features described above, or as an alternative, in further embodiments the support structure and the support member are formed from a substantially identical material.

In addition to one or more of the features described above, or as an alternative, in further embodiments the support structure and the support member are formed from different materials.

In addition to one or more of the features described above, or as an alternative, in further embodiments a drive machine is mounted to the support member and a traction sheave is mounted concentrically with a portion of the drive machine.

In addition to one or more of the features described above, or as an alternative, in further embodiments a width of the support structure is at least equal to a length of the traction sheave. The support structure is mounted to the support member generally adjacent the traction sheave.

In addition to one or more of the features described above, or as an alternative, in further embodiments the at least one component includes a first deflector sheave. The first deflector sheave has an axis of rotation substantially parallel to an axis of rotation of the traction sheave.

In addition to one or more of the features described above, or as an alternative, in further embodiments the at least one component additionally includes a second deflector sheave. The second deflector sheave is separated from the first deflector sheave by a distance and has an axis of rotation substantially parallel to an axis of rotation of the traction sheave.

In addition to one or more of the features described above, or as an alternative, in further embodiments at least one of the first deflector sheave and the second deflector sheave is substantially aligned with the traction sheave.

According to another embodiment, an elevator system is provided including an elevator hoistway, an elevator car movable along at least one car guide rail within said hoistway, a counterweight movable along at least one counterweight guide rail within said hoistway, and at least one tension member operably coupling the car and the counterweight. The elevator system additionally includes a machine assembly arranged in contact with the at least one tension member and configured to move the elevator car and counterweight within the hoistway. The machine assembly includes a support structure having a first end connected to an adjacent support member and a second end supported by at least one car guide rail. The support structure is arranged generally perpendicular to the support member and is configured to receive at least one component of the elevator system.

In addition to one or more of the features described above, or as an alternative, in further embodiments the elevator system does not include a machine room.

In addition to one or more of the features described above, or as an alternative, in further embodiments the second end of the support structure is not mounted to an adjacent wall of the hoistway.

BRIEF DESCRIPTION OF THE DRAWINGS

The subject matter, which is regarded as the disclosure, is particularly pointed out and distinctly claimed in the claims at the conclusion of the specification.

The foregoing and other features, and advantages of the disclosure are apparent from the following detailed description taken in conjunction with the accompanying drawings in which.

The detailed description explains embodiments of the disclosure, together with advantages and features, by way of example with reference to the drawings.

DETAILED DESCRIPTION OF THE DISCLOSURE

Figure 1:
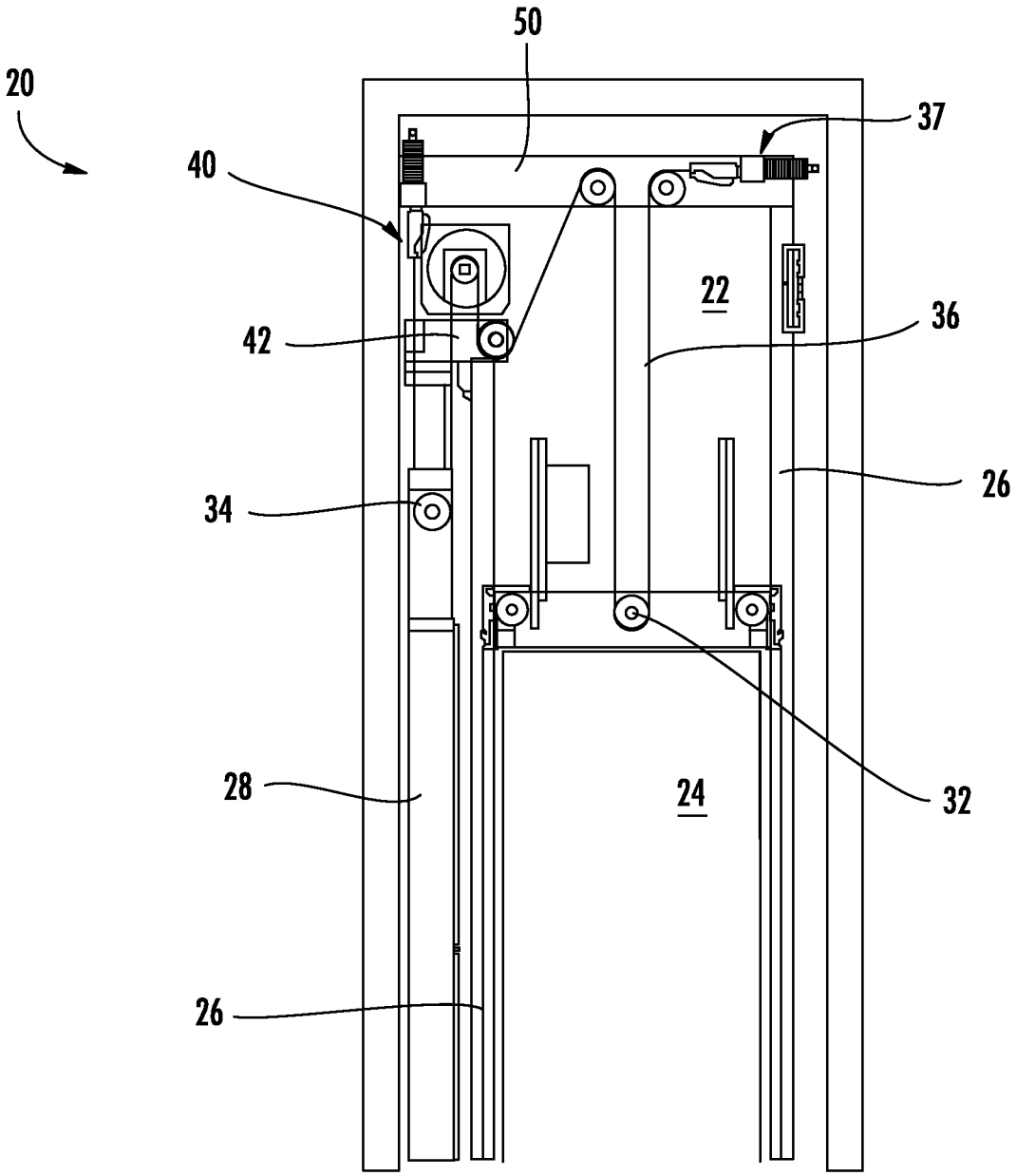
FIG. 1 is a front view of an example of an elevator system including a machine assembly according to an embodiment of the disclosure.
Figure 2:
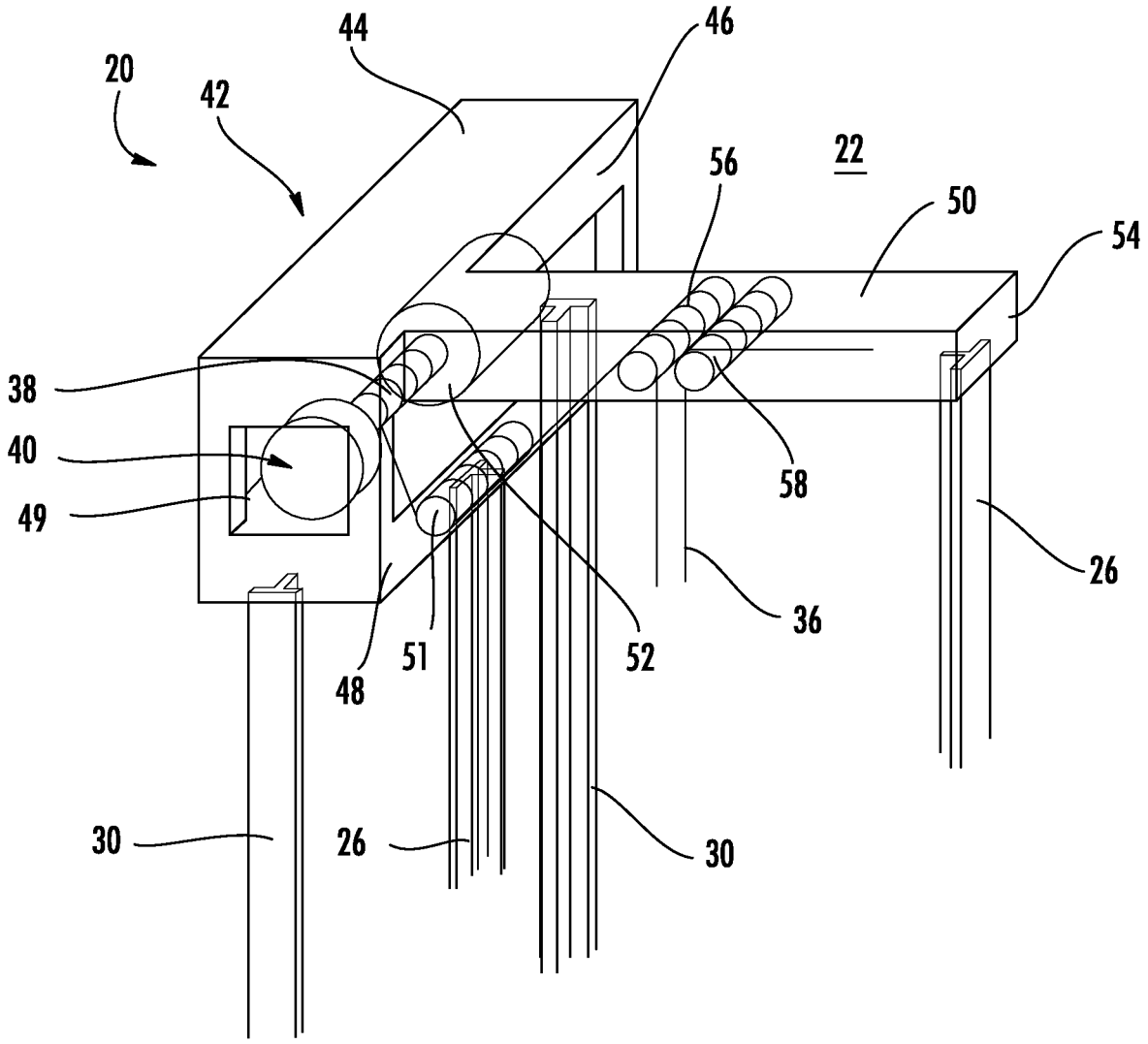
FIG. 2 is a perspective view of a machine assembly according to an embodiment of the disclosure.

Referring now to FIGS. 1 and 2, an example of an elevator system 20 is illustrated. The elevator system 20 includes an elevator car 24 configured to move vertically upwardly and downwardly within a hoistway 22 along a plurality of car guide rails 26. Guide assemblies mounted to the top and bottom of the elevator car 24 are configured to engage the car guide rails 26 to maintain proper alignment of the elevator car 24 as it moves within the hoistway 22.

The elevator system 20 also includes a counterweight 28 configured to move vertically upwardly and downwardly within the hoistway 22. The counterweight 28 moves in a direction generally opposite the movement of the elevator car 24 as is known in conventional elevator systems. Movement of the counterweight 28 is guided by counterweight guide rails 30 (FIG. 2) mounted within the hoistway 22. In the illustrated, non-limiting embodiment, the elevator car 24 and counterweight 28 include sheave assemblies 32, 34 that cooperate with at least one tension member 36 and a traction sheave 38 mounted to a drive machine 40 to raise and lower the elevator car 24. As shown, the ends of the tension members 36 are mounted at a fixed location in the hoistway via a hitch or dead end hitch 37. The drive machine 40 in the illustrated embodiment of the disclosure is suited and sized for use with flat tension members 36. In the illustrated, non-limiting embodiment, the sheave assembly 32 is mounted to the top of the elevator car 24. However, the sheave assembly 32 may be mounted at another location on the elevator car 24, such as the bottom of the elevator car 24 for example, or elsewhere in the elevator system 20 as recognized by a person skilled in the art.

The drive machine 40 of the elevator system 20 is positioned and supported at a mounting location upon a support member 42, such as a bedplate for example, in a portion of the hoistway 22. Although the elevator system 20 illustrated and described herein has an overslung 2:1 roping configuration, elevator systems 20 having other roping configurations and hoistway layouts are within the scope of the disclosure.

As illustrated in the FIGS., the support member 42 extends from a front to a back of the hoistway 22, in a direction substantially parallel to the axis of rotation of the drive machine 40. When installed within the hoistway 22, the support member 42 is positioned and supported at a mounting location atop at least one of the counterweight guide rails 30. The support member 42 may additionally or alternatively be mounted atop one of the plurality of car guide rails 26, for example the car guide rail 26 positioned adjacent the counterweight 28. By locating the support member 42 atop the counterweight guide rails 30 the need for a separate machine room, as required in conventional elevator systems, is eliminated.

The support member 42 may be configured such that the drive machine 40 is located below an uppermost surface 44 of the support member 42. In the illustrated, non-limiting embodiment, the support member 42 includes a frame having a connected upper member 46 and lower member 48 arranged parallel to one another. When configured as a frame, the support member 42 includes a hollow interior or cavity 49 within which the drive machine 40 is positioned. However, it should be understood that the support member 42 illustrated and described herein is an example and that embodiments where the drive machine 40 is located at another position relative to the support member 42, such as atop of the uppermost 44 surface thereof, are also within the scope of the disclosure. In addition, one or more components of the elevator system 20, such as a deflector sheave 51 or the counterweight side dead end hitches for example, may be configured to mount to a portion of the support member 42.

As illustrated in the FIGS., a support structure 50, such as a beam for example, extends from adjacent the support member 42 to an opposite side of the hoistway 22. The support structure 50 is oriented substantially perpendicular to the support member 42. The support structure 50 may be formed from any suitable material, including a metal or composite material for example. The support structure 50 may, but need not be formed from the same material as the support member 42. Although only a single support structure 50 is illustrated and described herein, embodiments including a plurality of support structures 50 are within the scope of the disclosure.

The support structure 50 is supported at a first end 52 by a connection with a portion of the support member 42, and is supported at a second, opposite end 54 by one of the plurality of car guide rails 26. In an embodiment, the second end 54 of the support structure 50 is not attached to an adjacent wall of the hoistway 22. The support structure 50 may attach to the upper member 46 of the support member 42, as shown in the FIGS. However, embodiments where the support structure 50 connects to another portion of the support member 42, such as the lower member 48 for example, are also contemplated. The support structure 50 may extend over the entire length of the support member 42, or alternatively, may extend over only a portion of the length of the support member 42. In one embodiment, the width of the support structure 50 is substantially equal to or slightly larger than the length of the traction sheave 38 mounted to the drive machine 40 (measured along the axis of rotation thereof).

One or more components of the elevator system 20 may be embedded within the support structure 50. In one embodiment, illustrated in FIG. 2, a first deflector sheave 56 and a second deflector sheave 58 are mounted within the support structure 50, such as within a corresponding first opening and second opening for example. The first and second deflector sheave 56, 58 may be arranged adjacent opposing sides of the deflector sheave 32 mounted to the top of the elevator car 24 (see FIG. 1). As shown, the axis of rotation of the first deflector sheave 56 and the second deflector sheave 58 are oriented substantially parallel to the axis of rotation of the drive machine 40. In such embodiments, the support structure 50 may be mounted to the support member 42 at a position adjacent the traction sheave 38 such that the grooves of the deflector sheaves 56, 58 mounted within the support structure 50 are substantially aligned with the grooves of the traction sheave 38. However, it should be understood that any number of deflector sheaves may be embedded within the support structure 50. In another embodiment, depending on the location of the support structure 50 within the hoistway 22, the dead end hitches 37 connected to the car-side ends of the tension members 36 may be configured to mount vertically or horizontally to the second end 54 of the support structure 50.

An elevator system 20 including a support member 42 upon which the drive machine 40 is mounted and a support structure extending perpendicular to the support member 42 provides a more efficient layout within the hoistway 22 than conventional systems. Further, the support structure 50 allows the deflector sheaves to be moved from the crosshead of the elevator car, thereby improving the ride quality of the system.

While the disclosure has been described in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that aspects of the disclosure may include only some of the described embodiments. Accordingly, the disclosure is not to be seen as limited by the foregoing description, but is only limited by the scope of the appended claims.

What is claimed is:

1. A machine assembly for use in an elevator system, comprising:

a support member positioned and supported atop at least one counterweight guide rail;

a drive machine mounted to the support member;

a traction sheave operably coupled to the drive machine;

a first deflector sheave mounted to the support member;

a support structure having a first end connected to the adjacent support member and a second end supported by at least one car guide rail, the support structure being arranged generally perpendicular to the support member and being configured to receive at least one component of the elevator system, wherein the at least one component includes a second deflector sheave and a third deflector sheave, the third deflector sheave being separated from the second deflector sheave by a distance, the second deflector sheave and the third deflector sheave each having an axis of rotation substantially parallel to the axis of traction sheave.

2. The machine assembly according to claim 1, wherein the at least one component includes a dead end hitch.

3. The machine assembly according to claim 2, wherein the dead end hitch is mounted vertically to the support structure.

4. The machine assembly according to claim 2, wherein the dead end hitch is mounted horizontally to the support structure.

5. The machine assembly according to claim 1, wherein the support structure and the support member are formed from a substantially identical material.

6. The machine assembly according to claim 1, wherein the support structure and the support member are formed from different materials.

7. The machine assembly according to claim 1, wherein the traction sheave is mounted concentrically with a portion of the drive machine.

8. The machine assembly according to claim 7, wherein a width of the support structure is at least equal to a length of the traction sheave, the support structure being mounted to the support member generally adjacent the traction sheave.

9. The machine assembly according to claim 1, wherein at least one of the second deflector sheave and the third deflector sheave is substantially aligned with the traction sheave.

10. An elevator system, comprising:

an elevator hoistway;

an elevator car movable along at least one car guide rail within said hoistway;

a counterweight movable along at least one counterweight guide rail within said hoistway;

at least one tension member operably coupling the car and the counterweight; and a machine assembly arranged in contact with the at least one tension member and configured to move the elevator car and counterweight within the hoistway, the machine assembly including:

a support member positioned and supported atop the at least one counterweight guide rail; and a drive machine mounted to the support member and a traction sheave operably coupled to the drive machine;

a first deflector sheave mounted to the support member;

a support structure having a first end connected to the adjacent support member and a second end supported by at least one car guide rail, the support structure being arranged generally perpendicular to the support member and being configured to receive at least one component of the elevator system, wherein the at least one component includes a second deflector sheave and a third deflector sheave, the third deflector sheave being separated from the second deflector sheave by a distance, the second deflector sheave and the third deflector sheave each having an axis of rotation substantially parallel to the axis of traction sheave.

11. The elevator system according to claim 10, wherein the elevator system does not include a machine room.

12. The elevator system according to claim 10, wherein the second end of the support structure is not mounted to an adjacent wall of the hoistway.

* * * * *